US006505675B2

(12) United States Patent
Komuro et al.

(10) Patent No.: US 6,505,675 B2
(45) Date of Patent: Jan. 14, 2003

(54) MOLTEN METAL POURING TIME DETERMINING APPARATUS

(75) Inventors: Yoshiaki Komuro, Nishinomiya (JP); Masanori Nishimura, Osaka (JP)

(73) Assignee: Sansha Electric Manufacturing Company, Limited, Osaka (JP)

( * ) Notice: Subject to any disclaimer, the term of this patent is extended or adjusted under 35 U.S.C. 154(b) by 23 days.

(21) Appl. No.: 09/795,268

(22) Filed: Feb. 28, 2001

(65) Prior Publication Data

US 2001/0018961 A1 Sep. 6, 2001

(30) Foreign Application Priority Data

Mar. 6, 2000 (JP) ..... 2000-060845

(51) Int. Cl.[7] ..... B22D 37/00
(52) U.S. Cl. ..... 164/155.6; 164/457
(58) Field of Search ..... 164/155.1, 154.6, 164/155.6, 457

(56) References Cited

U.S. PATENT DOCUMENTS 3,186,043 A 6/1965 Murtland, Jr. et al.
3,942,577 A 3/1976 Uozumi et al.
5,000,046 A 3/1991 Garcia et al.
5,633,462 A 5/1997 Heaslip et al.

FOREIGN PATENT DOCUMENTS

JP SHO 62-34453 7/1987
JP HEI 6-85991 11/1994

*Primary Examiner*—Kuang Y. Lin
(74) *Attorney, Agent, or Firm*—Duane Morris LLP

(57) ABSTRACT

A molten metal pouring time determining apparatus determines a proper time for pouring molten metal into a die. A mass of metal is placed in a melting pot. The melting pot and the metal mass are radio frequency (RF) induction heated with RF signal modulated with a low frequency signal. A light receiver receives light emitted by the metal mass heated in the melting pot and develops a received-light representative signal. A high-pass filter extracts a high frequency component developed by a sudden change in the received-light representative signal caused by the melting of the metal mass. A comparator develops an output signal when the output signal of the high-pass filter exceeds a reference signal. When the comparator output signal remains above the reference signal for a predetermined time period, a timer generates a molten metal pouring command signal.

9 Claims, 3 Drawing Sheets

MOLTEN METAL POURING TIME DETERMINING APPARATUS

This invention relates to an apparatus for timing pouring of molten metal into a die of a casting machine for die-casting small articles, such as dental articles and personal ornaments.

BACKGROUND OF THE INVENTION

U.S. patent application Ser. No. 09/415,282 filed on Oct. 8, 1999, now U.S. Pat. No. 6,250,367, entitled "Molten Metal Pouring Timing Determining Apparatus and Casting Machine", assigned to the assignee same as the assignee of the present application discloses an apparatus similar to the apparatus disclosed in the present application. This copending application is incorporated herein by reference.

Molten metals to be cast have their own proper timings when they should be poured into a die. If molten metal is poured in a die at a time earlier than its proper pouring timing, its viscosity is too high to spread over the entire cavity in the die, so that articles cannot be cast with precision. On the other hand, if the metal is poured later than the proper pouring timing, the casting temperature is so high that the metal may be evaporated, oxidized or degraded in composition. In addition, when the metal is poured into the die, it may stick to the die because of its high temperature. Like this, the timing of pouring molten metal into the die is critical to the quality of cast articles.

Conventionally, the time at which a molten metal should be poured into a die is determined by artisans, who monitors, by eyes, the metal being melted for minute vibrations, flow, deformation, glow, color etc. of the metal, to determine when the viscosity of the entire molten metal has decreased to a viscosity suitable for pouring the metal into the die.

The proper timing of the pouring of a metal into a die is correlated to the surface temperature of the molten metal. Therefore, it has been proposed to use an infrared radiation thermometer for measuring the surface temperature of a mass of molten metal to time the pouring of the metal. It is, however, very hard to detect an accurate surface temperature of a molten metal mass with an infrared radiation thermometer because of various reasons including the following ones. First, the amount of infrared radiation emitted differs from metal to metal. In addition, for a particular metal, the surface state of the molten metal mass changes from time to time, so that the amount of infrared radiation varies from time to time, too. Furthermore, from the time at which the metal starts melting and its viscosity starts decreasing, metal films, such as an oxide film, are formed to partly cover the surface of the molten metal mass and move on the surface, which causes the amount of emission of infrared radiation detected by the thermometer to randomly vary. Also, some metals may evaporate, and the evaporated metal gas and other gas may absorb or attenuate the emitted infrared light.

Fresh metal is not always used in casting, but metal obtained by cutting off unnecessary portions of a completed cast article may be recycled. Such recycled metal has a thick oxide film on its surface, which prevents detection of correct surface temperature of the molten metal. In addition, since an infrared radiation thermometer measures the temperature only at a small point on the surface of the molten metal mass, it is not possible to know the temperature of the molten metal as a whole. In other words, it is difficult to determine when the whole molten metal attains its proper pouring temperature, with the viscosity decreased to an appropriate value.

For the reasons as above stated, when an infrared radiation thermometer is used to determine the surface temperature of molten metal, a large error may result in measured temperature, which, in turn, may result in erroneous determination of the timing of pouring of the metal into a die. Thus, an infrared radiation thermometer is not always useable to precisely time the pouring of various metals under various melting conditions.

Another possible method to determine the optimum time for pouring may be to compare the shape of a mass of metal exhibited when it is heated and melted to flow with the shape of the mass of the metal when it is solid. However, this method is not applicable to some metals and recycled metals since they have a thick or hard oxide film on their surfaces, and, therefore, the shape or appearance changes only little even when the interior has melted and liquefied enough. This may cause the metals to be heated more than necessary, leading to defective casting.

Another problem in prior art is that when a plurality of solid lumps of metal are placed in a vessel for melting, they may melt in different times and in different ways, and, therefore, it is not possible or difficult to determine when all the metal lumps have melted into a uniform molten mass only from shape or appearance changes.

Because of the problems described above, it has been very difficult to reliably time pouring of molten metal in a casting machine under any of various melting conditions.

An object of the present invention is to provide an apparatus for timing to pour molten metal into a die.

SUMMARY OF THE INVENTION

According to one aspect of the present invention, an apparatus for timing the pouring of metal into a die of a die-casting machine is provided, which includes a melting vessel for receiving a metal material therein. Heating means heats the melting vessel by radio-frequency (RF) induction heating with a RF signal amplitude-modulated with a low frequency signal. A light receiver receives light emitted by the metal material in the melting vessel and develops a received-light-representative signal. Frequency component extracting means extracts a frequency component resulting from a sudden change in the received-light-representative signal. A pouring command signal generator generates a pouring command signal when the output signal of the frequency component extracting means exceeds a reference signal.

Radio-frequency induction heating has the following four characteristics.

(1) Immediately after entire metal is liquefied, the liquefied metal is electromagnetically stirred due to induction heating, which causes vibrations in the molten metal, which, in turn, results in a steep rising in the received-light-representative signal.

(2) A metal lump is heated from the outer portion thereof, and hot areas expand toward the center of the lump. Immediately before the electromagnetic stirring of the molten metal begins, the center portion of the lump is heated to a high temperature. At the time when the entire lump liquefies, the amount of light emitted by the liquefied increases rapidly, resulting in increase of the received-light-representative signal.

(3) At the time when the electromagnetic stirring begins, the surface state of the molten metal may suddenly changes. For example, the oxide film over the molten metal may partially broken, or a large opening may be formed in the oxide film. This causes an abrupt change in the amount of light emitted from the molten metal, resulting in increase of the received-light-representative signal.

(4) The amount of light emitted from the surface of the molten metal may suddenly change due to some other reasons, which also results in increase of the received-light-representative signal.

One or more of these four phenomena occur simultaneously around the time when the entire molten metal is liquefied. All of these phenomena appear as an abrupt change in the amount of emitted light or vibrations of the molten metal, either of which results in a rapid rising in a signal representing light received by the light receiver. This rapid rising in the received-light-representative signal is extracted with the frequency component extracting means to determine a proper time at which the molten metal should be poured into the die of the die-casting machine.

The pouring command signal generator may be arranged to generate a pouring command signal when the output signal from the frequency component extracting means continues to be above the reference signal for a predetermined time period. A change similar to a change which would appear in the received-light-representative signal when metal has been liquefied appears instantaneously when a heated lump of metal which has not yet been liquefied and, therefore, has a relatively low temperature moves in the vessel for some reason. The pouring time determined based on such change is not proper time. To avoid it, the pouring of molten metal is timed based only on a change in the received-light-representative signal caused by vibrations or abrupt increase in emitted light lasts a predetermined time.

The pouring command signal generator may include a comparator which develops an output signal only during a time period when the output signal of the frequency component extracting means is above the reference signal. When the comparator develops an output signal, the heating means operates to amplitude-modulate the RF signal with a low frequency signal, and the frequency component extracting means extracts the low frequency signal. Alternatively, the heating means may be so arranged as to amplitude-modulate the RF signal with a low frequency signal all the time throughout the operation, and increase the amplitude-modulation factor when the comparator develops an output signal. In the latter case, the modulation factor is initially small, and, therefore, the modulation is not detected by the frequency component extracting means.

With this arrangement, a rapid change in the received-light-representative signal causes the amplitude-modulation of the RF signal with a low frequency signal to be started, or the modulation factor to increase. If metal lump which has not yet been melted well moves, e.g. falls down, a rapid change cased in the received-light-representative signal by such movement is only instantaneous, and, therefore, the starting of the modulation of the RF signal with the low frequency signal, or an increase of the modulation factor, causes no pouring command signal to be generated. On the other hand, if the metal has been already well melted, the modulation with the low frequency signal or the increase of the modulation factor causes the molten metal to continuously vibrate due to the amplitude-modulation and electromagnetic stirring, which, in turn, causes the change in level of the received-light-representative signal to continue. This, in turn, causes the comparator to continuously develop the output signal, causing the pouring command signal to be developed. This arrangement can determine a proper pouring time more reliably.

The pouring command signal generator may include, in addition to the comparator which develops an output signal only during a time period in which the output signal of the frequency component extracting means is above the reference signal, a timer and a timer setting unit. In an automatic mode of operation of the molten metal pouring time determining apparatus, the timer develops the pouring command signal when the comparator continues to develop an output signal for a preset time period, and the timer setting unit sets in the timer, the time from the start of occurrence of the comparator output signal to the occurrence of the pouring command signal, measured in a manual mode of operation.

How to determine the time length for which the frequency component extracting means should continue developing its output signal, before molten metal is to be poured into a die, is highly experiential. Accordingly, in the manual operation mode, the time length is measured from the time when the output signal of the frequency component extracting means exceeds the reference signal to the time which the experienced operator judges is the time to pour molten metal into a die, causing the pouring command signal to be manually developed and the time measurement to be stopped. The measured time period is set in the timer. Thus, in the automatic mode of operation, the set time period determined by the experienced operator is used to determine the time to pour molten metal into a die.

The molten metal pouring time determining apparatus according to the present invention may include reference signal holding means. The reference signal holding means holds as the reference signal, the received-light-representative signal at the time when the rate of change of the received-light-representative signal is maximum or minimum.

Depending on the melting temperature, amount, shape and attitude in a melting pot or vessel of metal to be melted, the amount of light emitted and received from molten metal differs. Also, gas generated by the metal and stains on the melting pot can affect the amount of light received. Therefore, the level of the received-light representative signal differs, accordingly. Accordingly, the reference signal should be changed in accordance with the level of the received-light representative signal.

In general, increase in temperature of metal is relatively rapid immediately after the beginning of heating. The rate of change decreases before the start of the melting, and the increase in temperature almost stops from the beginning of the melting until the metal is completely melted. The change of the received-light representative signal exhibits a tendency corresponding to that of the temperature increase of the metal melted in the melting pot, with the level of the signal depending on the above-described various causes.

For this reason, the received-light representative signal at the time when the rate of change of the received-light representative signal is maximum (i.e. the time immediately following the start of heating) or minimum (i.e. the time when the melting begins) is held as the reference signal. With this arrangement, the precision for timing the pouring of molten metal does not decrease regardless of the above-described causes for changing the signal level because the reference signal changes, corresponding to such causes.

The amplitude modulation provided by the heating means may be stopped in response to the generation of the molten metal pouring command signal. The pouring command signal can be used as a drive signal for driving an arrangement to cause the molten metal to be poured from a melting pot into a die. An "aging" time may be disposed before driving the pouring arrangement so that substantially the entire molten metal can have the same temperature and viscosity. During this aging time, the modulation with a low frequency signal of the RF heating signal is interrupted so that the molten metal in the melting pot can be stabilized and stationary, whereby the molten metal can be uniformly poured into a die.

A casting machine can be provided by combining a molten metal pouring command unit with the molten metal pouring time determining apparatus, which causes molten metal to be poured into a die from a melting pot in response to the molten metal pouring command signal generated by the molten metal pouring time determining apparatus.

DESCRIPTIONS OF PREFERRED EMBODIMENT

Figure 1:
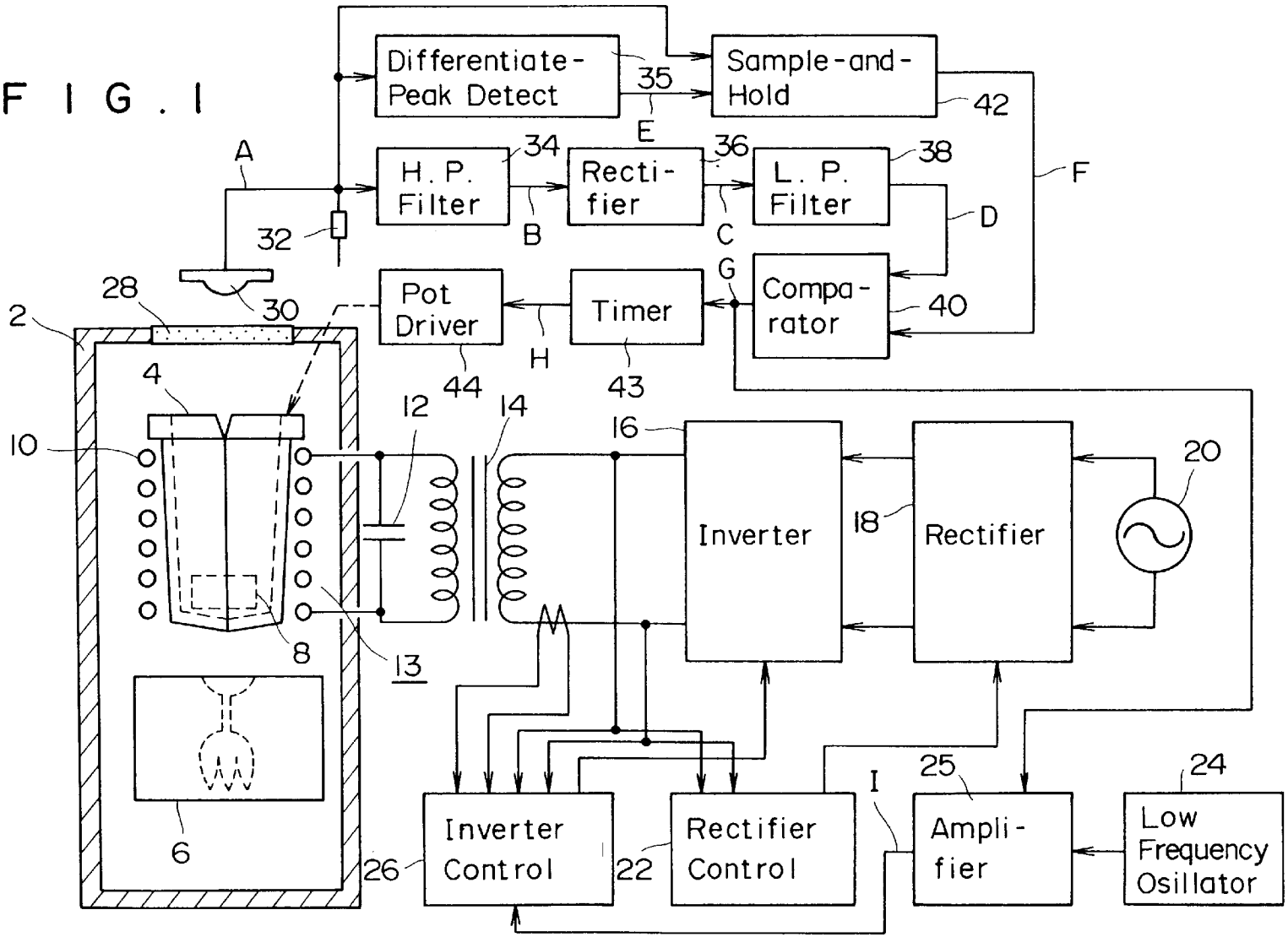
FIG. 1 is a block diagram of a casting machine with a molten metal pouring time determining apparatus according to a first embodiment of the present invention.

FIG. 1 illustrates a molten metal pouring time determining apparatus according to a first embodiment of the present invention incorporated into a casting machine for casting a small article, e.g. an artificial tooth.

The casting machine has a chamber 2. A melting pot or melting vessel 4 is positioned in an upper part of the chamber 2. Below the melting pot 4 is a die 6. The melting pot 4, is disposed in an upper portion of the chamber 2. The melting pot 4 is formed of two halves having vertically extending mating surfaces. When a mass of metal 8 within the melting pot 4 has been melted, the lower ends of the two halves of the melting pot 4 are opened, and the molten metal is poured into the die 6. The structure of the melting pot 4 and the arrangement for opening the melting pot 4 may be of known ones, and, therefore, they are not described in detail.

The melting pot 4 is RF (radio frequency) induction heated by heating means. The heating means includes an RF induction heating coil 10 disposed around the melting pot 4. The coil 10 is connected in parallel with a resonant capacitor 12 to form a tank circuit 13. The tank circuit 13 is connected in the secondary side of a matching transformer 14. The primary side of the transformer 14 is coupled to the output of an inverter 16, which provides a RF (radio Frequency) signal for RF induction heating. The inverter 16 includes at least one semiconductor switching device, e.g. a thyristor, an IGBT, a power FET or a power bipolar transistor.

The input of the inverter 16 is connected to the output of a rectifying circuit 18 providing a controlled DC output voltage. The rectifying circuit 18 includes at least one semiconductor switching device, e.g. a thyristor, an IGBT, a power FET or a power bipolar transistor. The input of the rectifying circuit 18 is connected to a commercial AC power supply 20.

A rectifier control circuit 22 for controlling the rectifying circuit 18 includes a reference signal generator which generates a reference signal for use in constant voltage control. The control circuit 22 detects the output voltage of the inverter 16 and feedback controls the semiconductor switching device of the rectifying circuit 18 in such a manner as to make the output voltage of the inverter 16 have a fixed value corresponding to the reference signal.

An inverter control circuit 26 is provided in association with the inverter 16. The inverter control circuit 26 detects the output voltage and the phase of the output current of the inverter 16, and controls the switching frequency of the switching device of the inverter 16 in such a manner that the switching frequency can be equal to the resonance frequency of the tank circuit 13.

The inverter control circuit 26 is supplied with a low frequency signal I which is an output signal of a low-frequency oscillator circuit 24 amplified in a variable gain amplifier 25. The low frequency signal I has a frequency of about 10 Hz and may have, for example, a sinusoidal shape, a rectangular shape or a shape of combination thereof. If the frequency of the low frequency signal is too high, vibrations of metal caused by change in shape of the mass of metal 8 during melting are little due to the mechanical inertia of the metal 8, which makes it difficult to detect the completion of the melting. There are optimum shape, magnitude and frequency of the modulating wave for a particular combination of the kind of the metal 8, the weight of the mass of metal 8, the shape of the mass of metal 8 and the shape of the melting pot 4. However, they should be set to be effective for as wide a variety of metals as possible. Accordingly, the stated frequency of about 10 Hz is only an example.

The inverter control circuit 26 detects the phase difference between the output voltage and output current of the inverter 16 to make the frequency of the inverter output current equal to the resonant frequency of the tank circuit 13 so that the resonant current of the tank circuit 13 can be always maximum. A slight phase difference is intentionally introduced between the output voltage and current of the inverter 16 by means of the low frequency modulating signal. With such a phase difference introduced, a slight difference is introduced between the resonant frequency of the tank circuit 13 and the frequency of the output current of the inverter 16, which caused the resonant current of the tank circuit 13 to decrease. The equality and inequality in frequency is made to alternate periodically by the modulating signal, which, in turn, causes the magnitude of the resonant current of the tank circuit 13 to be amplitude modulated with the modulating signal.

In order for the constant voltage control provided by the rectifier control circuit 22 not to be affected by variations of the output voltage of the inverter 16 provided by the amplitude modulation, the response time of the constant voltage control provided by the rectifier control circuit 22 is chosen to be sufficiently long relative to the period of the modulating signal.

The coil 10, the capacitor 12, the transformer 14, the inverter 16, the rectifier circuit 18, the rectifier control circuit 22, the inverter control circuit 26, the variable gain amplifier 25 and the low frequency oscillator circuit 24 form heating means.

A glass plate 28 is disposed in the top portion of the chamber 2. Light emitted by the molten metal in the melting pot 4 can pass through the glass plate 28. A light receiver 30, e.g. an infrared photodiode or a pyroelectric sensor, is disposed in such a manner that it can receive light emitted from the molten metal mass.

As the mass of metal 8 in the crucible 4 is heated, the amount of light emitted from the molten metal increases in substantial proportion to the temperature of the metal 8. The light emitted by the molten metal is received by the light-receiver 30, which converts the received light into a received-light representative signal A, which is developed as a voltage across a load resistor 32. The voltage, i.e. received-light representative signal, is applied to frequency component extracting means, e.g. filter means, or, more specifically, a high-pass filter 34. The high-pass filter 34 allows frequency components above the frequency of the low frequency signal generated by the low frequency oscillator circuit 24 to pass therethrough, but cuts off higher frequency components.

Also, in order to prevent inappropriate operation which would be caused by noise, a bandpass filter may be used, which allows only a frequency component having the frequency of the low frequency oscillator circuit 24.

Figure 2:
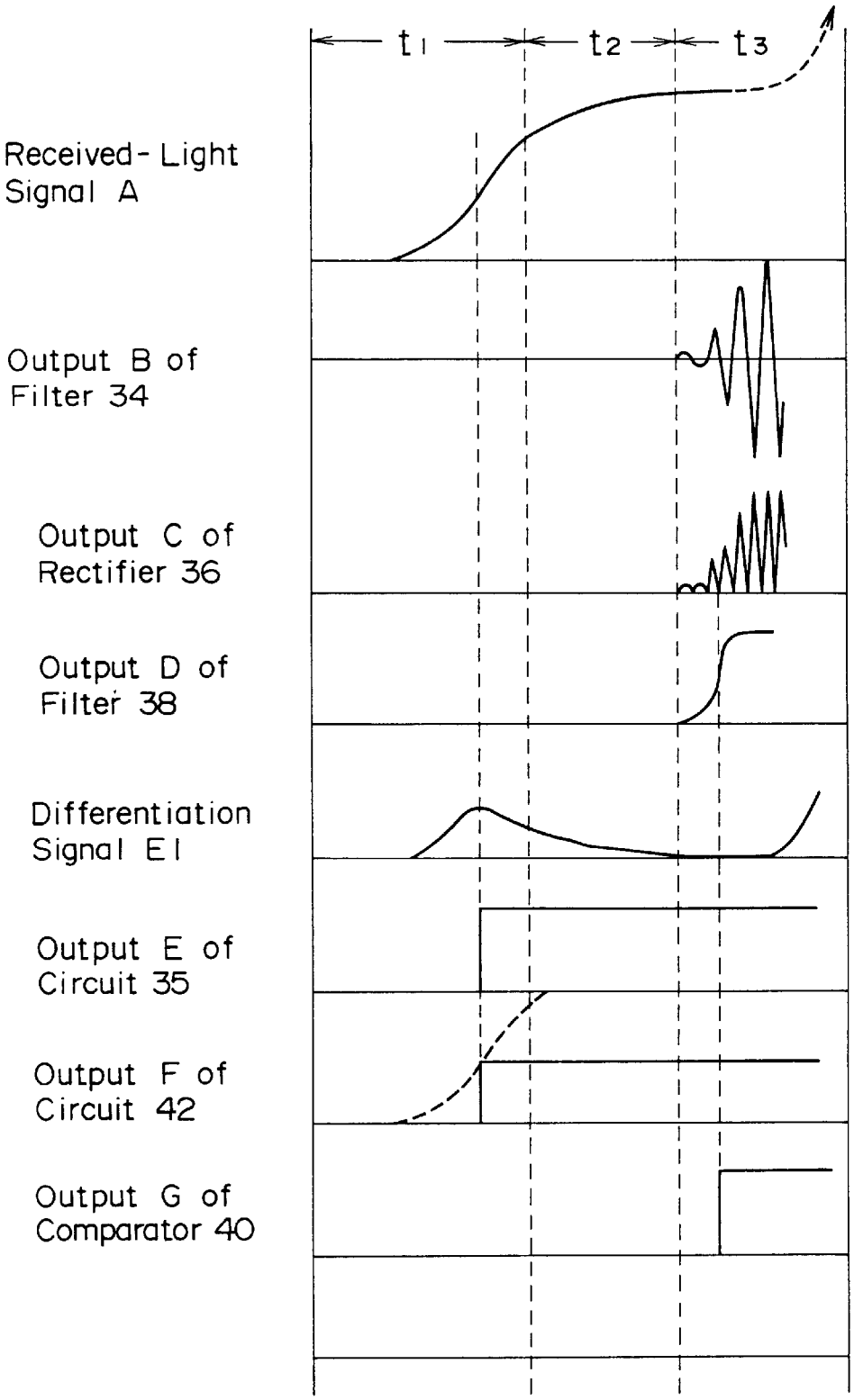
FIG. 2 shows signal waveforms at various portions of the casting machine of FIG. 1.

In FIG. 2, a level change of the received-light representative signal A from the beginning of the heating of the mass of metal 8 is illustrated. During a portion of a heating period $t_1$ immediately following the beginning of the heating, the rate of increase of the temperature of the metal mass 8 is small, and, therefore, the received-light representative signal A exhibits almost no change. As the heating continues, the temperature of the metal mass 8 rises rapidly and the metal mass 8 starts to become red-hot. In a time period $t_2$ preceding the melting of the mass of metal 8, the increase of temperature becomes gradual more and more, resulting in a gradual increase of the level of the received-light representative signal A. The heating continues further, but the temperature rises little. In a melting period $t_3$ following the period $t_2$, the mass of metal 8 starts melting. The peripheral portions of the mass of metal 8 first melt. In this portion of the melting period $t_3$, there is almost no temperature rise, and, therefore, there is substantially no change in the received-light representative signal A. When the heating continues after the metal mass 8 has been entirely melted, the molten metal 8 starts to boil, and the received-light representative signal A increases rapidly as represented by a broken line.

In the time periods $t_1$ and $t_2$, the mass of metal 8 is not melted sufficiently, substantially no influence of the modulation with the low frequency signal is seen in the received-light representative signal A, and the signal A varies at a frequency sufficiently lower than the cut-off frequency of the high-pass filter 34. Accordingly substantially no change appears in an output signal B of the high-pass filter 34, as shown in FIG. 2.

In the melting period $t_3$, the mass of metal 8 gradually melts. When the entire metal mass 8 melts, a rapid change appears in the received-light representative signal A from the light-receiver 30 because of rapid increase of vibrations due to electromagnetic stirring, breakage of a surface oxide film over the metal mass 8, rapid increase of the light emission, etc., which causes high frequency components to appear in the received-light representative signal A. This, in turn, results in oscillations appearing in the output signal B of the high-pass filter 34. The high-pass filter output signal B is applied to a full-wave rectifier circuit 36, which develops a full-wave rectified output signal C as shown in FIG. 1. The waveform of the signal C is shown in FIG. 2. The output signal C is then applied to a low-pass filter 38, which may be provided by a smoothing circuit, where it is smoothed into an output signal D (FIG. 2) for application to a voltage-comparator 40, as shown in FIG. 1. In place of the full-wave rectifier circuit 36, a half-wave rectifier may be used.

The received-light representative signal A is also applied to a differentiation and peak detection circuit 35 and to a sample-and-hold circuit 42. The differentiation and peak detection circuit 35 differentiates the received-light representative signal A. The waveform of the differentiated version of the received-light representative signal A, which is developed within the circuit 35 is illustrated as a signal E1 in FIG. 2. When the first peak appears in the differentiation signal E1, the differentiation and peak detection circuit 35 detects the peak and develops a timing signal E (FIG. 2). The signal E is applied as a timing signal for the sample-and-hold circuit 42. When receiving the timing signal, the sample-and-hold circuit 42 samples and holds the level of the received-light representative signal A present when the timing signal is applied, and applies the sampled and held level as a reference signal F (FIG. 2) to the voltage comparator 40. The reference signal F represents the level of the received-light representative signal A at the time when the rate of increase of temperature of the metal mass 8 is maximum.

The timing signal for the sample-and-hold circuit 42 has been described to be developed when the differentiation signal E1 exhibits a peak, but it may be so arranged as to be developed when the differentiation signal E1 exhibits a minimum value. The minimum value is exhibited when the rate of change of the received-light representative signal A is smallest, i.e. immediately before the metal mass 8 starts melting.

The voltage comparator 40 compares the output signal D of the low-pass filter 38 with the reference signal F from the sample-and-hold circuit 42, and develops a comparator output signal G (FIG. 2) when the output signal D is larger than the reference signal F.

The comparator output signal G is applied, as a gain control signal, to the variable gain amplifier 25. The gain of the amplifier 25 remains very small until the gain control signal is applied to it, and, therefore, the low frequency signal I at the output of the variable gain amplifier 25 is small. Accordingly, the amplitude-modulation provided by the inverter control circuit 26 is also small. The variable gain amplifier 25, upon receiving the gain control signal from the voltage comparator 40, increases its gain so that the level of the low frequency signal I becomes larger. The level-increased low frequency signal I is applied to the inverter control circuit 26. Thus, the inverter control circuit 26 amplitude-modulates the RF signal from the inverter 16 with an increased amplitude-modulation factor.

When rapid increase of vibrations due to electromagnetic stirring of the entirely melted metal mass 8, breakage of the oxide film over the molten metal mass 8 and rapid increase of light emitted from the molten metal mass 8 are detected, the comparator output signal G is developed, and, immediately after it, the RF signal is amplitude-modulated with an increased modulation factor. As a result, vibrations of the molten metal mass 8 are sustained. The development of the comparator output signal G continues as long as vibrations of the metal mass 8 continue.

On the other hand, if the entire metal mass 8 has not yet been melted, but the metal mass 8 simply moves in the melting pot 4, the comparator output signal G is instantaneously developed, so that the RF signal for induction heating is amplitude modulated with a large modulation factor. However, since the entire mass of metal 8 has not yet been melted, the movement or vibration of the metal mass 8 is not sustained. As a result, the comparator output signal G disappears, resulting in decrease of the amplitude-modulation factor, so that only the heating with the RF signal is continued.

The comparator output signal G is applied also to a timer circuit 43 as shown in FIG. 1. The timer circuit 43 develops a molten metal pouring command signal H when the application of the comparator output signal G to the timer circuit 43 continues for a predetermined time interval. The pouring command signal H is applied to drive a melting pot driving arrangement 44. Accordingly, when the comparator 40 develops the output signal G instantaneously, no pouring command signal is developed, but if the entire mass of metal 8 has been already melted and the comparator output signal G is sustained for longer than the predetermined time interval, the molten metal pouring command signal H is developed.

It is arranged such that when receiving the pouring command signal H from the timer circuit 43, the melting pot driving arrangement 44 does not immediately open the melting pot 4, but the melting pot is opened after an "again" time period of from one to three seconds lapses. The aging time period is disposed for the purpose of melting the entire metal mass and making it sure for the entire metal mass to have the same temperature and viscosity. When the aging time period lapses, the melting pot 4 is opened and the molten metal is poured from the melting pot 4 into the die 6.

In order to stabilize the flow of the molten metal mass 8 into the die 6, the amplitude modulation provided by the inverter control circuit 26 is stopped during the aging time period. This may be done by, for example, applying the pouring command signal to the variable gain amplifier 25 to make the gain of the amplifier 25 zero.

Experiments show that the time interval set for the timer circuit 43, for which the comparator output signal G must be sustained for the pouring command signal H to be developed by the timer circuit 43, should be longer as the melting point of the metal to be melted is higher. This time interval can be determined based on the relation to the melting point of metal. Accordingly, prior to starting automated casting operation, the time period for the metal to be melted is set in the timer circuit 43.

This time interval set in the timer circuit can be adjusted, taking the melting characteristics of various metals into consideration, when more precise casting is required.

The differentiation and peak detection circuit 35, the sample-and-hold circuit 42, the full-wave rectifier circuit 36, the low-pass filter 38, the voltage comparator 40 and the timer circuit 43 form a molten metal pouring command signal generator.

Instead of amplitude modulating the RF signal with a low frequency signal from the beginning of the heating, the gain of the variable gain amplifier 25 may be kept zero until the comparator output signal G is developed so that no amplitude modulation is provided. In this case, when the comparator output signal G is developed, the gain of the amplifier 25 is increased so as to provide the amplitude modulation with the low frequency signal.

In the above-described example, molten metal is poured from the melting pot 4 into the die 6 after the aging time period of from about 1 to about 3 seconds, during which the amplitude modulation of the RF signal is not provided, but it may be so arranged that the heating means is so controlled in a short time period of, for example, from about 0.1 to about 0.2 seconds before the end of the aging time period, as to apply to the molten metal mass 8 in the melting pot 4, RF power greater than the RF power provided when the gain of the variable-gain amplifier 25 is made zero. The application of such RF power to the molten metal mass 8 makes the molten metal mass 8 round, whereby the molten metal mass 8 can gush out of the melting pot 4 into the die 6. Also, it can prevent residues of the molten metal from adhering to the inner wall of the melting pot 4. For this purpose, the timer 43 may be used to detect the beginning of the short time period before the end of the aging time period and, when detecting the beginning of the short time period, provide such a control signal to the inverter control circuit 26 as to increase the RF power. Alternatively, the timer 43 may provide such a control signal to the variable-gain amplifier 25 to increase the gain to its maximum value.

Figure 3:
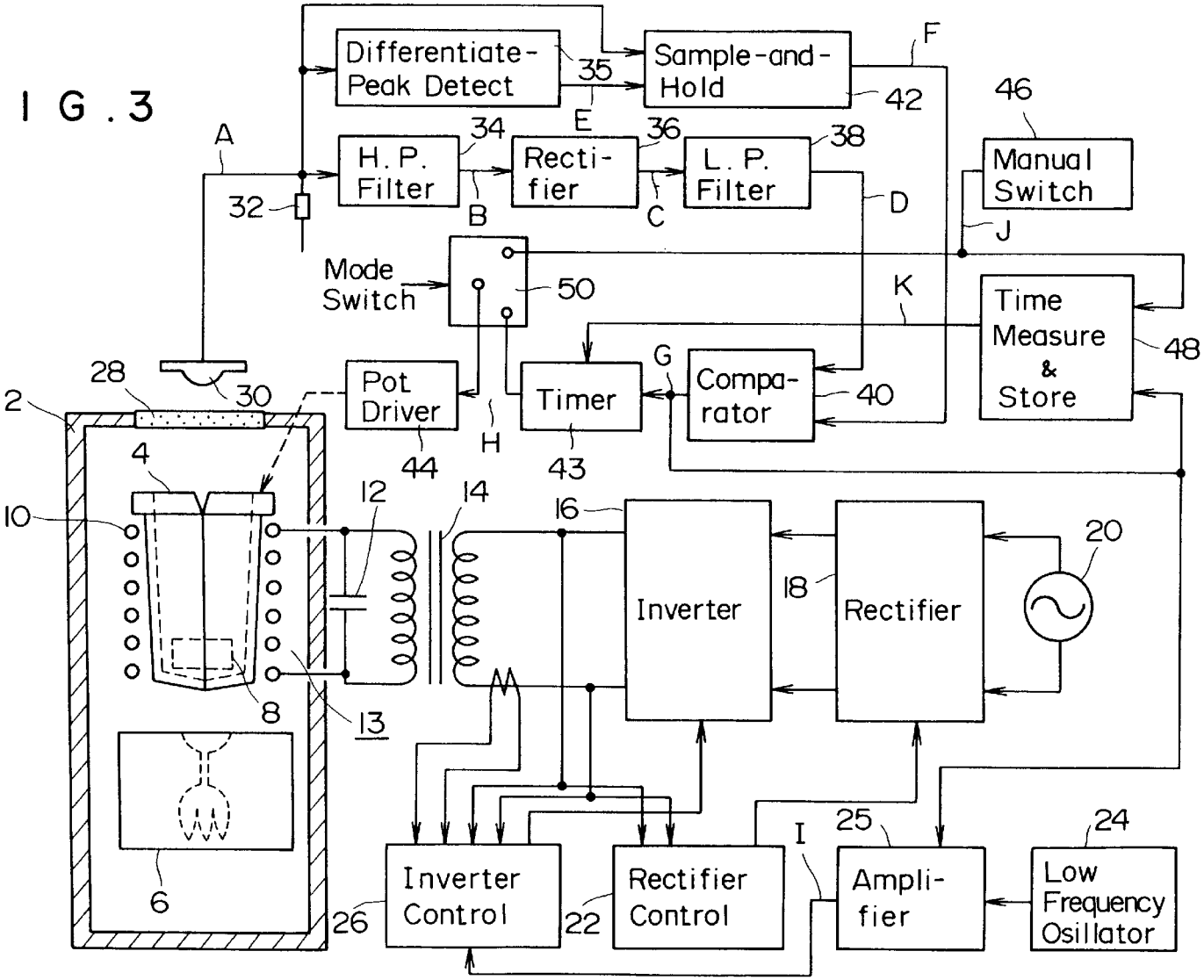
FIG. 3 is a block diagram of a casting machine with a molten metal pouring time determining apparatus according to a second embodiment of the present invention.

FIG. 3 shows a casting machine with a pouring time determining apparatus according to a second embodiment of the present invention. The structure of this casting machine is generally same as that of the casting machine shown in FIG. 1, except for the following.

According to the second embodiment, once an artisan or skilled operator manually input the melting pot drive signal at the time that he or she judges is the best time for pouring, in a modified version of the pouring time determining apparatus according to the first embodiment, the time difference between this time determined by the artisan and the time when rapid vibrations due to electromagnetic stirring of the molten mass or rapid increase of light emitted from the molten metal mass is detected automatically by the apparatus, is determined and stored. The determined time difference is automatically converted to the time to be set in the timer circuit 42 and stored and set in the timer circuit 42. Then, the artisan's technique of determining the proper pouring time is automatically reproduced in the succeeding casting operation.

Referring to FIG. 3, the casting machine with the pouring time determining apparatus according to the second embodiment is now described in detail.

The casting machine shown in FIG. 3 is the casting machine shown in FIG. 1 to which a manual melting-pot driving switch 46, a time measuring and storing circuit 48 and a mode switch 50 are added. The same reference numerals or letters are attached to the components, signals and functions as the ones of the first embodiment shown in FIGS. 1 and 2, and no further description is given for them.

First, the mode switch 50 is placed in a manual casting mode position as illustrated in FIG. 3 so that an output signal J of the manual melting-pot driving switch 46 is applied through the mode switch 50 to the melting pot driving arrangement 44. The manual melting-pot driving switch 46 is turned on to develop the signal J at the time the skilled artisan determines to be appropriate for pouring the molten metal into the die 6. The artisan determines the time, watching the state of the metal mass 8 being melted. The output signal J of the manual melting-pot driving switch 46 is applied through the mode switch 50 to the melting pot driving arrangement 44 so as to pour the molten metal mass 8 into the die 6.

The output signal J is also applied to the time measuring and storing circuit 48, which starts measuring time when the comparator output signal G is applied to it. In other words, the circuit 48 starts to measure time when rapid increase of the vibrations of the molten metal mass 4 due to electromagnetic stirring, breakage of the surface oxide film over the molten metal mass 8 and/or rapid increase of the light emitted from the molten metal mass 8 occur. The measurement of time is stopped when the output signal J of the manual melting-pot driving switch 46 is applied to the time measuring and storing circuit 48. In other words, the circuit 48 stops measuring time when the skilled artisan determines it is the most appropriate time to pour the molten metal mass 8 into the die 6. The measured time interval is stored in the circuit 48.

When the mode switch 50 is switched to an automatic mode to receive the output signal H of the timer circuit 43, a signal K representative of the time interval stored in the time measuring and storing circuit 48 is sent to the timer circuit 43, and the time interval set in the timer circuit 43. Alternatively, the measured time interval may be set in the timer circuit 43 immediately after the measurement of time by the time measuring and storing circuit 48 is stopped.

In place of a photodiode or pyroelectric sensor, an image sensor, e.g. a CCD, may be used as the light receiver 30 to detect the amount of light emitted by the metal mass 8 being melted and provide the received-light representative signal A. By detecting, in addition, the image of the metal mass 8 being melted, by the image sensor to show the image to the operator of the machine, or to process the image in a computer to provide a computer-processed image, a casting machine easier to operate with higher precision would result.

The pouring time determining apparatus has been described as being provided by analog signal processing circuitry, but a computer may be used to convert the output signal of the light receiver 30 into a digital signal, with the differentiation and peak detection circuit 35, the sample-and-hold circuit 42, the high-pass filter 34, the full-wave rectifier circuit 36, the low-pass filter 38, the voltage comparator 40, the timer circuit 43 and the melting pot driving arrangement 44 digitized.

What is claimed is:

1. A molten metal pouring time determining apparatus comprising:

a melting pot for receiving a metal material therein;

heating means for radio frequency (RF) induction heating said melting pot and the metal material therein with a RF signal;

a light receiver for receiving light emitted by the metal material in said melting pot and developing a received-light representative signal representing the received light;

frequency component extracting means for extracting a frequency component resulting from a sudden change in said received-light-representative signal; and a pouring command signal generator for generating a pouring command signal when an output signal of said frequency component extracting means exceeds a reference signal.

2. The apparatus according to claim 1 wherein said pouring command signal generator generates the pouring command signal when the output signal of said frequency component extracting means exceeds and remains above said reference signal for a predetermined time interval.

3. The apparatus according to claim 2 wherein:

said pouring command signal generator includes a comparator developing an output signal only during a time period when the output signal of said frequency component extracting means is above said reference signal;

said heating means amplitude-modulates said RF signal with a low frequency signal when said comparator develops an output signal; and said frequency component extracting means extracts said low frequency signal.

4. The apparatus according to claim 1 wherein:

said pouring command signal generator includes a comparator developing an output signal only during a time period when the output signal of said frequency component extracting means is above said reference signal;

said heating means amplitude-modulates said RF signal with a low frequency signal, a modulation factor of the amplitude-modulation being increased when said comparator develops an output signal; and said frequency component extracting means extracts said low frequency signal.

5. The apparatus according to claim 1 wherein said pouring command signal generator comprises:

a comparator developing an output signal only during a time period when the output signal of said frequency component extracting means is above said reference signal;

a timer for generating said pouring command signal in an automatic mode of operation of said apparatus, when the output signal of said comparator is continuously applied to said timer for a time interval set in said timer; and a timer setting unit for setting in said timer, as said time interval to be set in said timer, a time interval measured in a manual mode of operation of said apparatus, from a time when said comparator develops an output signal to a time when a manual pouring command signal is generated.

6. The apparatus according to claim 1 further comprising reference signal holding means for holding, as said reference signal, said received-light representative signal at a time when the rate of change of said received-light representative signal is maximum.

7. The apparatus according to claim 1 further comprising reference signal holding means for holding, as said reference signal, said received-light representative signal at a time when the rate of change of said received-light representative signal is minimum.

8. The apparatus according to claim 3 wherein said heating means stop amplitude-modulating said RF signal in response to the generation of said pouring command signal.

9. The apparatus according to claim 2 wherein said heating means is so controlled as to increase said RF signal only for a short time period before the end of said predetermined time interval.

* * * * *

UNITED STATES PATENT AND TRADEMARK OFFICE

CERTIFICATE OF CORRECTION

PATENT NO. : 6,505,675 B2 
DATED : January 14, 2003
INVENTOR(S) : Yoshiaki Komuro and Masanori Nishimura It is certified that error appears in the above-identified patent and that said Letters Patent is hereby corrected as shown below:

Title page,
Item [*], Notice, add -- This patent is subject to a terminal disclaimer. --.

Signed and Sealed this

Twenty-fourth Day of June, 2003

JAMES E. ROGAN
*Director of the United States Patent and Trademark Office*